US007070434B2

(12) United States Patent
Paul et al.

(10) Patent No.: US 7,070,434 B2
(45) Date of Patent: Jul. 4, 2006

(54) ROCKET-LAUNCHER DOCKING SYSTEM

(75) Inventors: Buddy R. Paul, Perry Hall, MD (US); Greg W. Klein, Bel Air, MD (US)

(73) Assignee: Lockheed Martin Corporation, Bethesda, MD (US)

( * ) Notice: Subject to any disclaimer, the term of this patent is extended or adjusted under 35 U.S.C. 154(b) by 169 days.

(21) Appl. No.: 10/899,654

(22) Filed: Jul. 27, 2004

(65) Prior Publication Data

US 2006/0021497 A1 Feb. 2, 2006

(51) Int. Cl.
*H01R 13/52* (2006.01)

(52) U.S. Cl. ..... 439/271; 439/289; 174/35 GC

(58) Field of Classification Search ..... 439/271, 439/289, 290; 174/35 GC
See application file for complete search history.

(56) References Cited

U.S. PATENT DOCUMENTS 3,185,955 A * 5/1965 Keller ..... 439/357
3,431,348 A * 3/1969 Lamp et al. ..... 174/35 GC
3,835,443 A * 9/1974 Arnold et al. ..... 439/319
4,166,663 A * 9/1979 Walker et al. ..... 439/289
4,349,241 A * 9/1982 Juris et al. ..... 439/88
4,529,257 A * 7/1985 Goodman et al. ..... 439/271
4,563,052 A * 1/1986 Dietrich ..... 439/610
5,035,639 A * 7/1991 Kilpatrick et al. ..... 439/290
5,107,071 A * 4/1992 Nakagawa ..... 174/35 GC
5,752,845 A * 5/1998 Fu ..... 439/247
6,188,014 B1 * 2/2001 Richard et al. ..... 174/35 R
6,462,960 B1 * 10/2002 Watanabe ..... 361/816
6,822,161 B1 * 11/2004 Komatsu et al. ..... 174/35 GC

* cited by examiner

*Primary Examiner*—Tho D. Ta
(74) *Attorney, Agent, or Firm*—DeMont & Breyer LLC

(57) ABSTRACT

An electrical connector that avoids some of the disadvantages associated with electrical connectors in the prior art. In particular, the illustrative embodiment of the present invention uses spring-loaded contacts to maintain connection in the presence of the vibration associated with a rocket launch, and also includes an environmental seal and electro-magnetic shield so as to provide an environment for the electrical contacts that is isolated from the ambient environment and external electromagnetic radiation. Furthermore, the illustrative embodiment avoids the possibility of bent connector pins, which would make mating between the electrical connectors.

17 Claims, 8 Drawing Sheets

ROCKET-LAUNCHER DOCKING SYSTEM

The U.S. Government has a paid-up license in this invention and the right in limited circumstances to require the patent owner to license others on reasonable terms as provided for by the terms of Contract No. DAAH01-03-C-0035 awarded by the U.S. Government.

FIELD OF THE INVENTION

BACKGROUND OF THE INVENTION

Mobile multi-cell rocket launchers are used by the military to provide firepower during a combat situation. The launcher electronics (e.g., control, power, and targeting systems, etc.) and launch platform necessary to control and fire each rocket are bulky and expensive; therefore, modern multi-cell rocket launchers use modularity to reduce overall system cost and bulkiness.

A common infrastructure, which includes the launcher electronics and launch platform, is used in conjunction with replaceable canisters, which each contain a rocket. Each canister provides a substantially air-tight environment that reduces the rocket's exposure to dust, humidity, and other environmental factors. The canisters need to be easily replaced in a combat situation; i.e. it must be possible to quickly remove a spent canister and replace it with a fresh canister to replenish the total firepower of the launcher.

In the prior art, the loading of a canister into a launch platform requires complicated handling by the crew manning the platform. In particular, in order to connect the electronics contained within the canister to the launcher electronics (i.e., the electronics NOT contained in the canister), the crew must attach the electrical cables associated with the platform to the electrical cables associated with the canister. Furthermore, the crew must ensure that the cables are not severed or damaged while the canisters are loaded.

Therefore, the need exists for an electrical connection that avoids or mitigates some or all of these problems.

SUMMARY OF THE INVENTION

The present invention enables a docking system for a rocket-containing canister and a launch platform that avoids some of the disadvantages for doing so in the prior art. In particular, the illustrative embodiment of the present invention uses mechanical alignment features, spring-loaded electrical contacts, an environmental seal, and an electro-magnetic radiation shield to establish and maintain reliable electrical interconnection between the rocket and the launcher electronics.

The present invention enables a rocket-containing canister to be loaded into a multi-cell rocket launcher while also establishing electrical connection between the rocket and launcher electronics associated with the multi-cell rocket launcher. Once established, the electrical interconnection between the rocket and multi-cell rocket launcher is maintained even in the presence of the vibration associated with a rocket launch, dirt or other airborne contaminants, or external electro-magnetic radiation.

The illustrative embodiment comprises: a spring-loaded electrical contact, a seal for providing an environmental seal, and a shield for providing an electro-magnetic-interference shield, wherein both the environmental seal and the electro-magnetic-interference shield surround the spring-loaded contact so that when the electrical connector is mated, the spring-loaded contact is enclosed in an environment that is substantially isolated from the ambient environment and substantially isolated from external electro-magnetic radiation.

DETAILED DESCRIPTION

Figure 1:
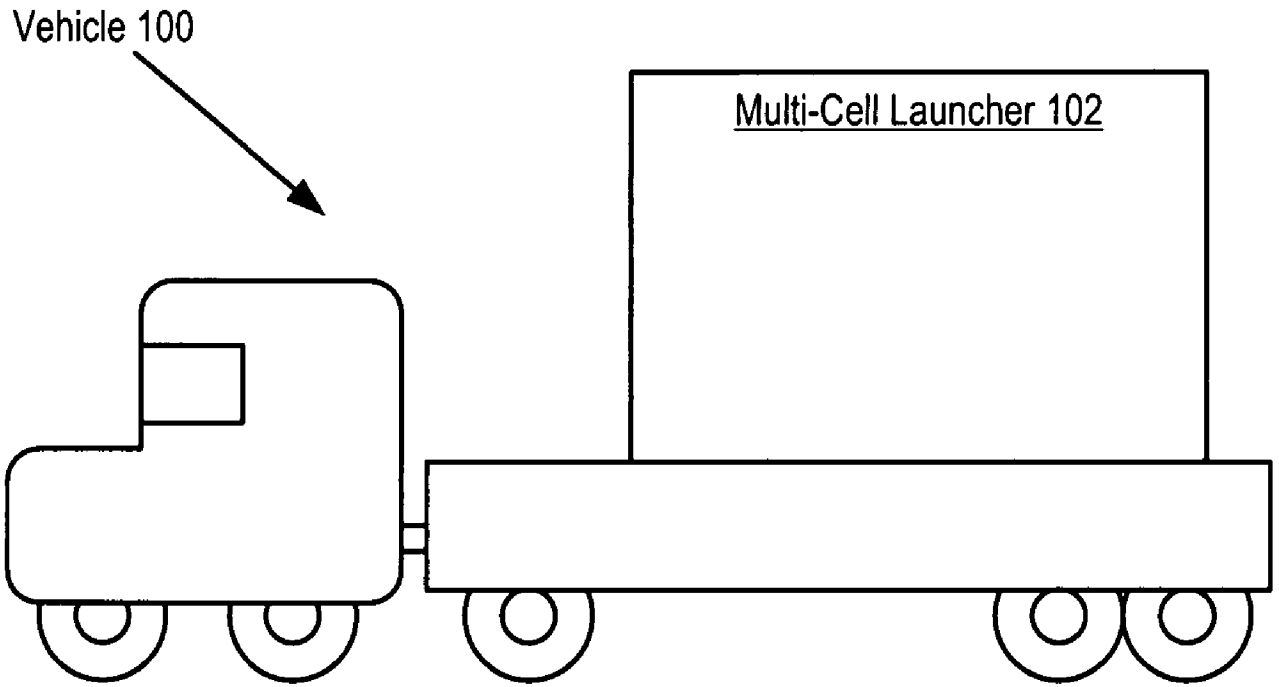
FIG. 1 depicts a representational diagram of the salient components of a vehicle-borne multi-cell launcher in accordance with the illustrative embodiment.

FIG. 1 depicts a representational diagram of the salient components of a vehicle-borne multi-cell launcher in accordance with the illustrative embodiment. Although multi-cell launcher 102 is mounted on vehicle 100, it will be clear to those skilled in the art how to make and use alternative embodiments of the present invention in which multi-cell launcher 102 is mounted on another vehicle, such as a railroad car, warship, submarine, space vehicle, satellite, or stationary ground-based platform.

Figure 2:
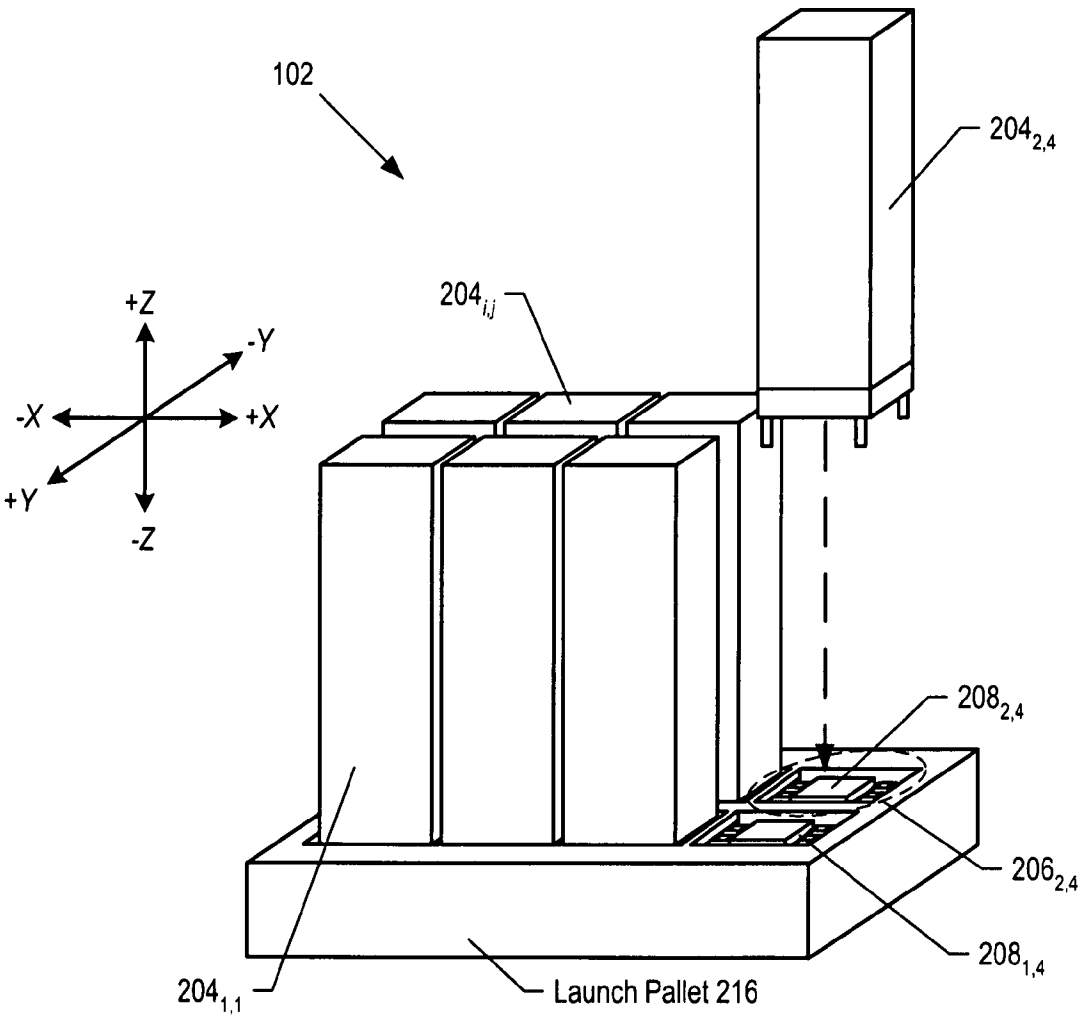
FIG. 2 depicts a perspective view of the salient components of a multi-cell launcher in accordance with the illustrative embodiment of the current invention.

FIG. 2 depicts a perspective view of the salient components of multi-cell launcher 102. Launcher 102 comprises eight canisters $\mathbf{206}_{1,1}$ through $\mathbf{206}_{2,4}$, and launch pallet 216. Launch pallet 216 comprises eight canister receptacles $\mathbf{217}_{1,1}$ through $\mathbf{217}_{2,4}$, and pallet connectors $\mathbf{218}_{1,1}$ through $\mathbf{218}_{2,4}$ (for clarity, only receptacles $\mathbf{217}_{1,4}$ and $\mathbf{217}_{2,4}$ and pallet connectors $\mathbf{218}_{1,4}$ and $\mathbf{218}_{2,4}$ are shown). Although multi-cell launcher 102 comprises eight canisters and eight canister receptacles, it will be clear to those skilled in the art, after reading this disclosure, how to make and use embodiments of the present invention that comprise any number of canisters and canister receptacles.

Multi-cell launcher 102 is a system that has the capability of launching a plurality of rockets from its launch platform. Launch pallet 216 accepts and holds rocket-containing canisters $\mathbf{204}_{i,j}$ in canister receptacle $\mathbf{206}_{i,j}$ wherein i is a positive integer in the set $\{1, \ldots 2\}$, and j is a positive integer in the set $\{1, \ldots 4\}$. After a rocket is launched from canister $\mathbf{204}_{i,j}$, the spent canister can be replaced by an unused canister to replenish the fire power of multi-cell launcher 102.

Launch pallet 216 comprises canister receptacles $\mathbf{206}_{1,1}$ through $\mathbf{206}_{2,4}$, which provide mechanical structure to which canisters $\mathbf{204}_{1,1}$ through $\mathbf{204}_{2,4}$ are mounted. In addition, each canister receptacle $\mathbf{206}_{i,j}$ includes pallet connector $\mathbf{208}_{i,j}$, which provides an electrical interface between canister $\mathbf{206}_{i,j}$ and fire control.

Figure 3:
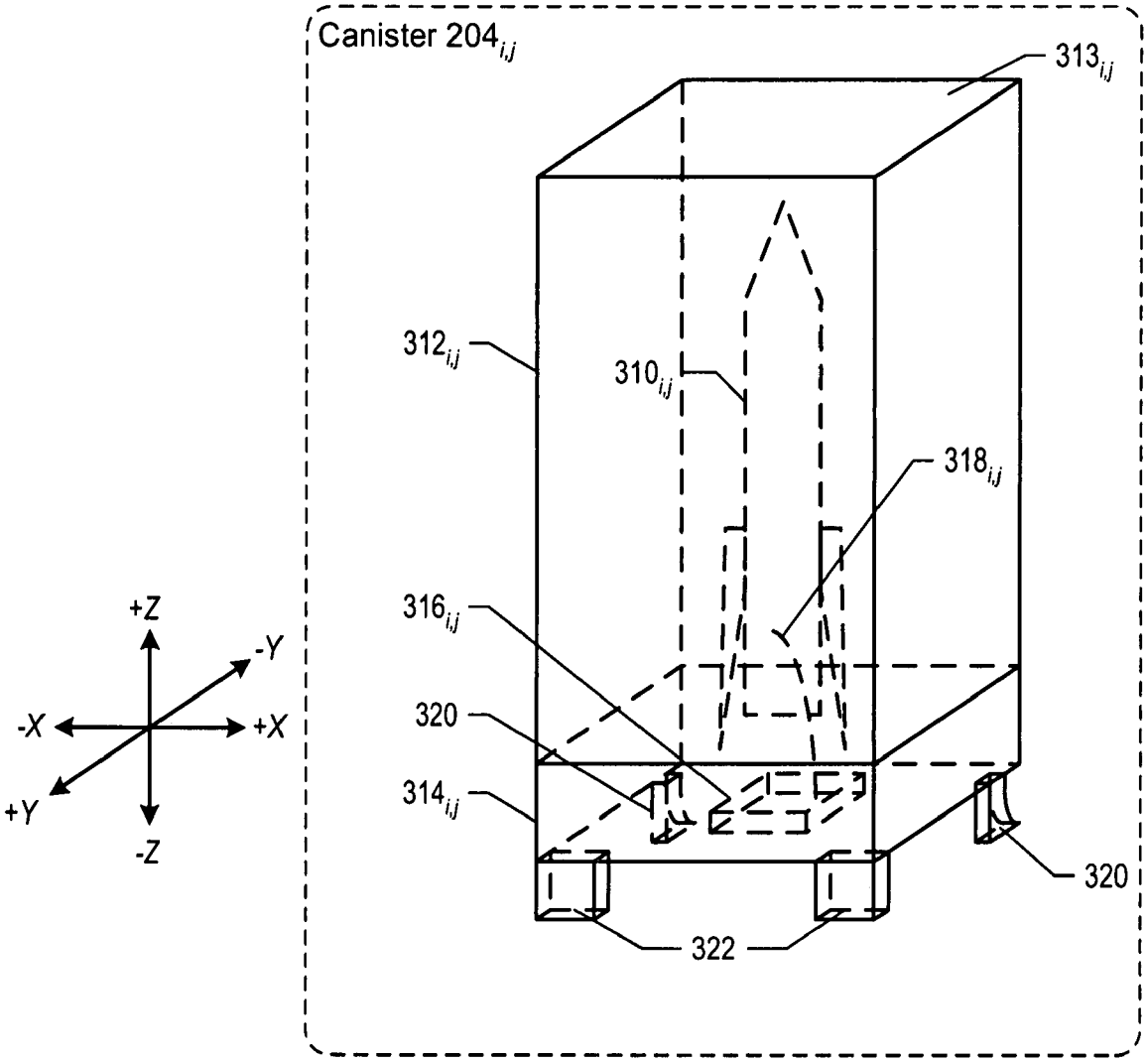
FIG. 3 depicts a perspective view of the salient components of a representative canister in accordance with the illustrative embodiment of the current invention.

FIG. 3 depicts a perspective view of the salient components of canister $\mathbf{204}_{i,j}$. Canister $\mathbf{204}_{i,j}$, comprises rocket $\mathbf{310}_{i,j}$, housing $\mathbf{312}_{i,j}$, connector plate $\mathbf{314}_{i,j}$, canister connector $\mathbf{316}_{i,j}$, canister-to-rocket umbilical $\mathbf{318}_{i,j}$, rear legs 320, and front legs 322.

Housing $\mathbf{312}_{i,j}$, fly-through cover $\mathbf{313}_{i,j}$, and connector plate $\mathbf{314}_{i,j}$ are sheet metal that form a substantially weather-proof and dust-proof environment for rocket $\mathbf{310}_{i,j}$, such that rocket $\mathbf{310}_{i,j}$ does not suffer from environmental conditions (e.g., dust, rain, dirt, etc.).

Figure 4:
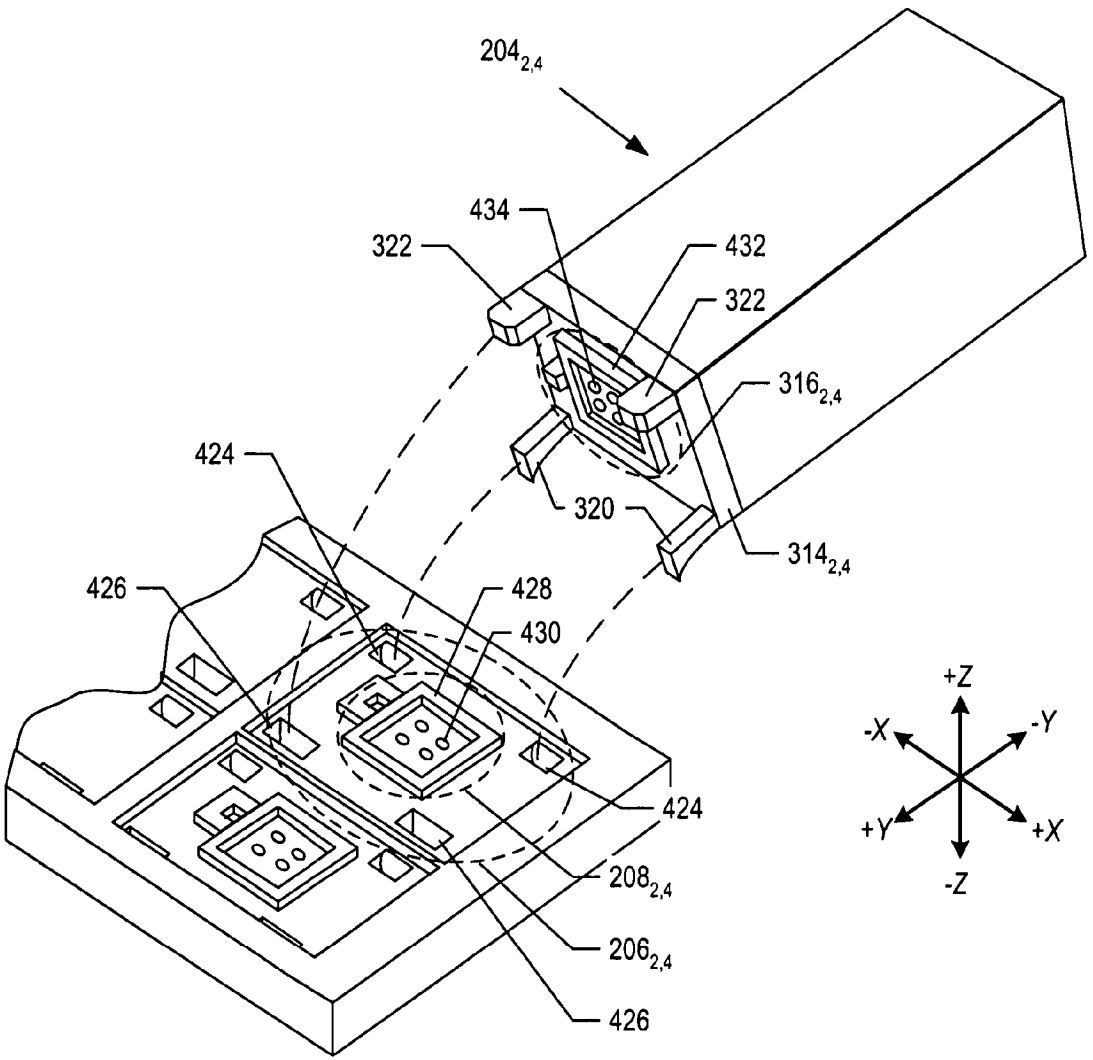
FIG. 4 depicts an exploded view of the salient components of a canister and a receptacle in accordance with the illustrative embodiment of the current invention.

Connector plate $\mathbf{314}_{i,j}$ comprises canister connector $\mathbf{316}_{i,j}$, rear legs 320, and front legs 322. Canister connector $\mathbf{316}_{i,j}$ mates with pallet connector $\mathbf{208}_{i,j}$ when rear legs 320 and front legs 322 are engaged with their respective alignment holes, rear slots 424 and front slots 426 (which are depicted in FIG. 4). When canister $\mathbf{204}_{i,j}$ is inserted into receptacle $\mathbf{206}_{i,j}$, rear legs 320 and front legs 322 engage rear slots 424 and front slots 426 in a single orientation, and, as a consequence, canister connector $\mathbf{316}_{i,j}$ is properly aligned with pallet connector $\mathbf{208}_{i,j}$ to ensure the interconnection of their appropriate contacts.

FIG. 4 depicts an exploded view of the salient components of canister $\mathbf{204}_{2,4}$ and receptacle $\mathbf{206}_{2,4}$ in accordance with the illustrative embodiment of the current invention. Canister $\mathbf{204}_{2,4}$ includes connector plate $\mathbf{314}_{2,4}$, which comprises canister connector $\mathbf{314}_{2,4}$, rear legs 320, and front legs 322. Receptacle $\mathbf{206}_{2,4}$ comprises pallet connector $\mathbf{208}_{2,4}$, rear slots 424, and front slots 426. Further, and as depicted in more detail in FIG. 5, canister connector $\mathbf{316}_{2,4}$ comprises canister annulus 432 and canister contacts 434, and pallet connector $\mathbf{208}_{2,4}$ comprises pallet annulus 428 and pallet contacts 430.

As canister $\mathbf{204}_{2,4}$ engages receptacle $\mathbf{206}_{2,4}$, rear legs 320 engage rear slots 424 such that canister $\mathbf{204}_{2,4}$ can only seat in receptacle $\mathbf{206}_{2,4}$ in a single orientation. Once rear legs 320 have engaged rear slots 424, canister $\mathbf{204}_{2,4}$ rotates into position above receptacle $\mathbf{206}_{2,4}$ enabling front legs 322 to be inserted into front slots 426. The insertion of rear legs 320 and front legs 322 into slots 424 and 426 aligns canister connector $\mathbf{316}_{2,4}$ and pallet connector $\mathbf{208}_{2,4}$.

Figure 5:
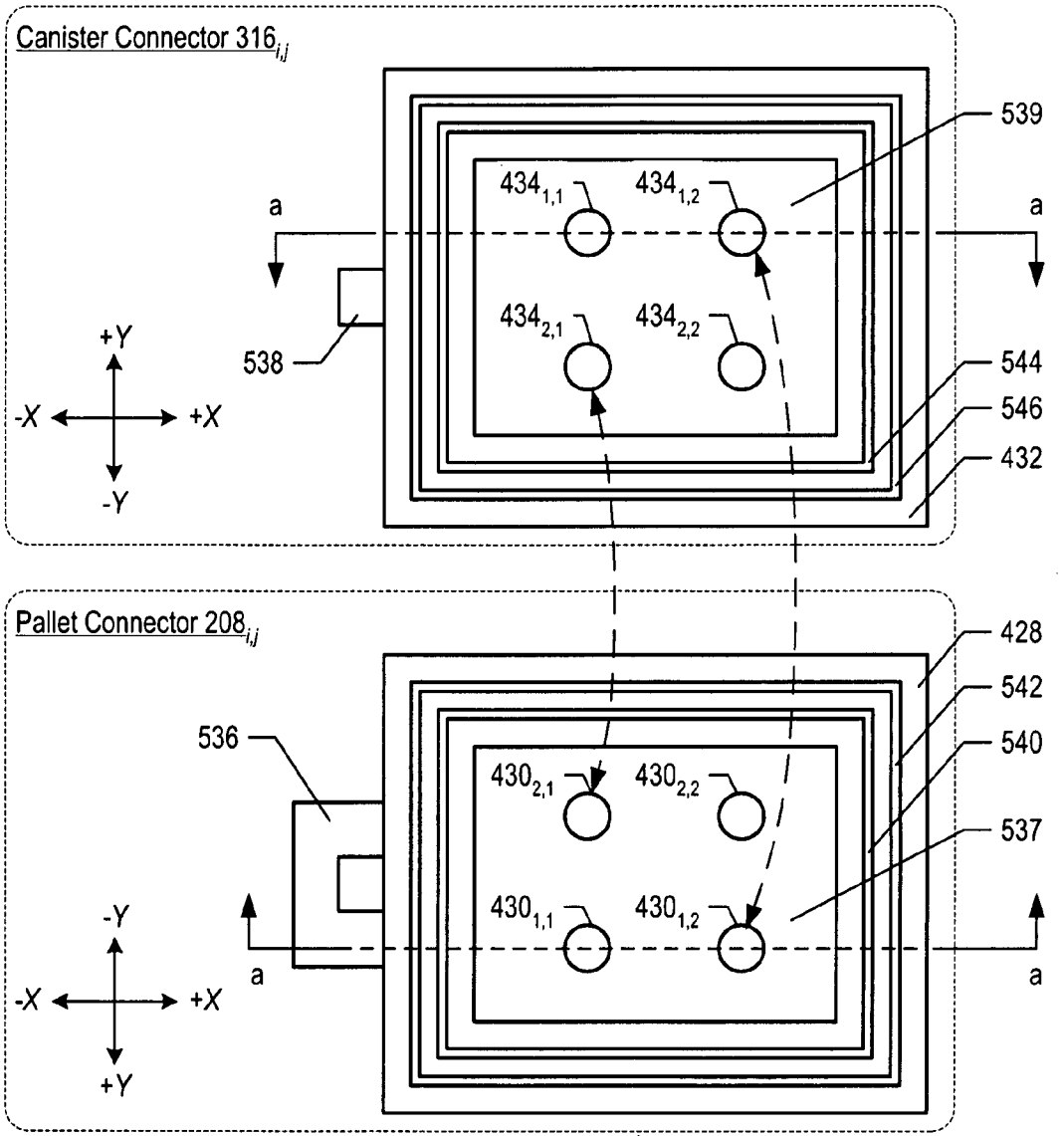
FIG. 5 depicts a top-down view of the salient components of a pallet connector and a bottom-up view of a canister connector in accordance with the illustrative embodiment of the current invention.

FIG. 5 depicts a top-down view of the salient components of pallet connector $\mathbf{208}_{i,j}$ and a bottom-up view of canister connector $\mathbf{316}_{i,j}$ in accordance with the illustrative embodiment of the current invention. Canister connector $\mathbf{316}_{i,j}$ comprises canister annulus 432, shield seat 544, seal seat 546, contacts $\mathbf{434}_{1,1}$ through $\mathbf{434}_{2,2}$ (collectively, contacts 434), canister connector face 539, and canister key 538.

Pallet connector $\mathbf{208}_{i,j}$ comprises pallet annulus 428, shield seat 540, seal seat 542, contacts $\mathbf{430}_{1,1}$ through $\mathbf{430}_{2,2}$ (collectively, contacts 430), pallet connector face 537, and pallet key 536.

Canister connector $\mathbf{316}_{i,j}$ and pallet connector $\mathbf{208}_{i,j}$ include pallet key 536 and canister key 538, respectively, and are designed to mate in a single orientation that ensures proper interconnection of contacts 434, which depend from canister connector face 539, with contacts 430, which depend from pallet connector face 537, (i.e., contact $\mathbf{434}_{1,1}$ interconnected to $\mathbf{430}_{1,1}$, . . . , $\mathbf{434}_{2,2}$ interconnected to $\mathbf{430}_{2,2}$). Additionally, correct alignment of pallet connector $\mathbf{208}_{i,j}$ and canister connector $\mathbf{316}_{i,j}$ ensures that shield seat 540 aligns with shield seat 544, and seal seat 542 aligns with seal seat 546 such that when seat 648 and shield 650 are present (as depicted in FIGS. 6 and 7), shield 650 is located in shield seats 540 and 544, and seal 648 is located in seal seats 542 and 546.

Figure 6:
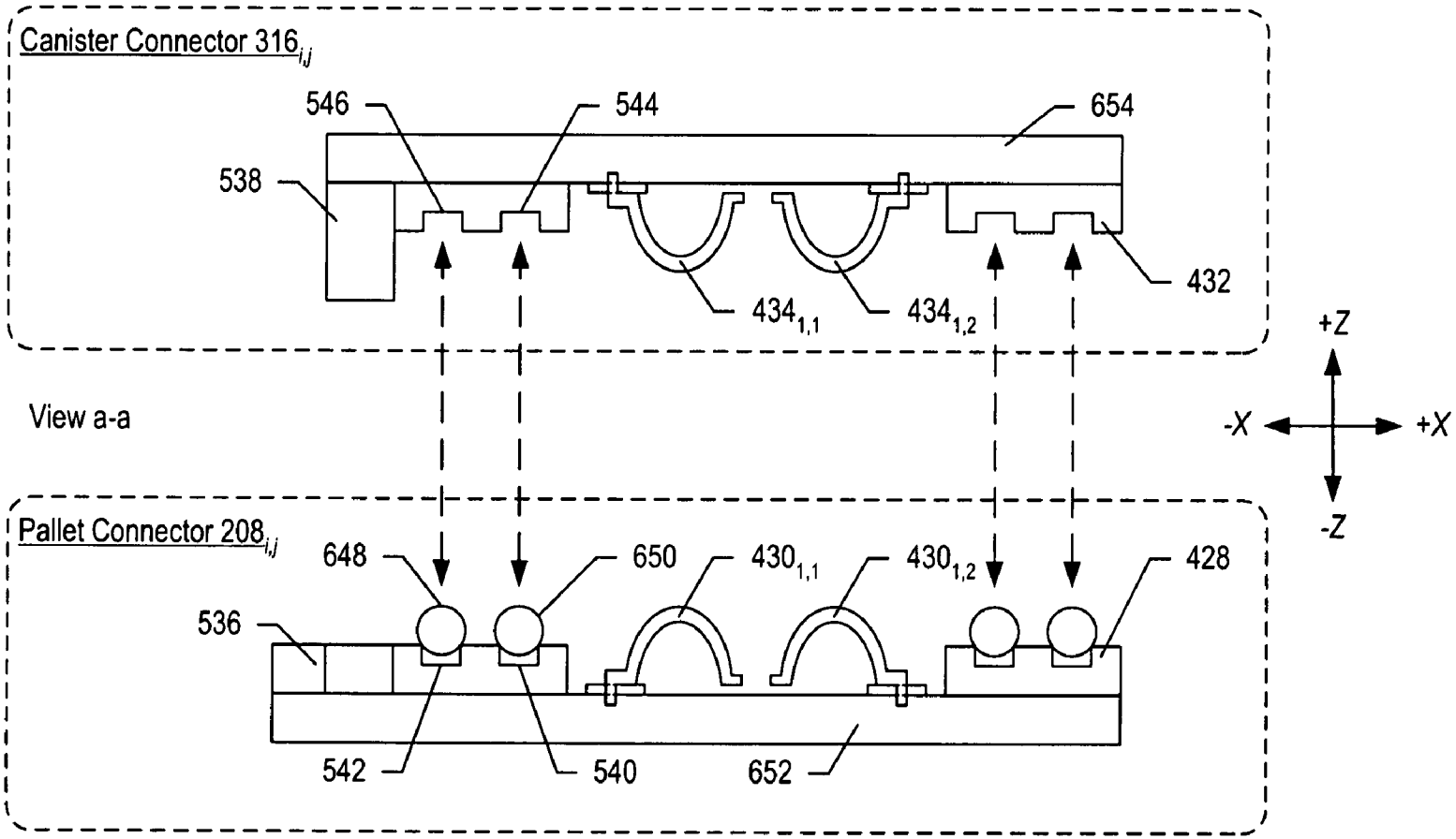
FIG. 6 depicts an exploded cross-sectional view of the salient components of a pallet connector and a canister connector in accordance with the illustrative embodiment of the current invention.
Figure 7:
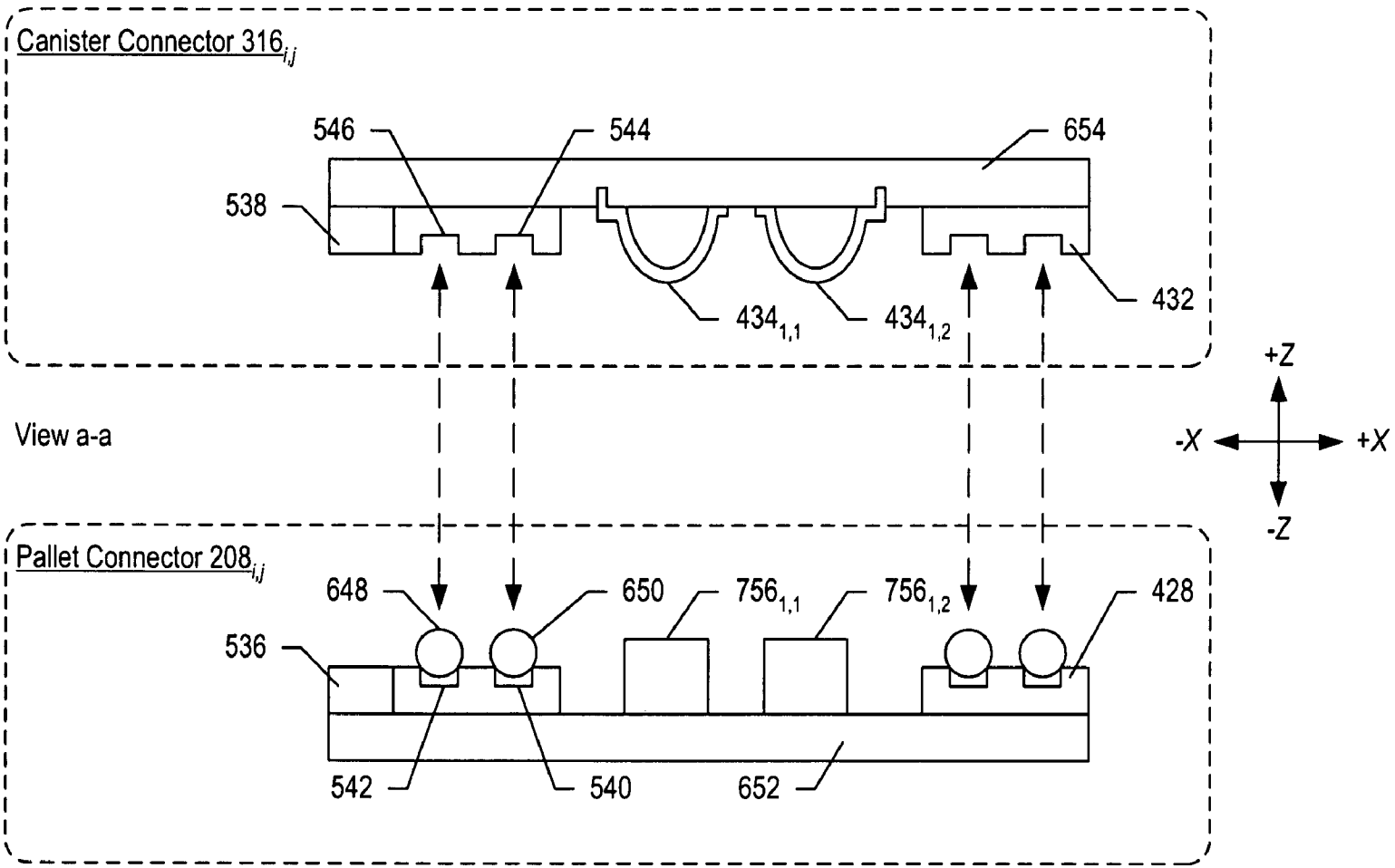
FIG. 7 depicts a cross-sectional view of the salient components of an alternative embodiment of the present invention.

FIG. 6 depicts an cross-sectional view of the salient components of pallet connector $\mathbf{208}_{i,j}$ and canister connector $\mathbf{316}_{i,j}$, as taken through line a—a of FIG. 5, in accordance with the illustrative embodiment of the current invention. Pallet connector $\mathbf{208}_{i,j}$ comprises circuit board 652, pallet annulus 428 that includes shield seat 540 and seal seat 542, resilient contacts $\mathbf{430}_{1,1}$ and $\mathbf{430}_{1,2}$, pallet key 536, shield 650, and seal 648. Canister connector $\mathbf{316}_{i,j}$ comprises printed circuit board 654, canister annulus 432 that includes shield seat 544 and seal seat 546, resilient contacts $\mathbf{434}_{1,1}$ and $\mathbf{434}_{1,2}$, and pallet key 538.

Circuit board 652 provides connection between resilient contacts $\mathbf{430}_{1,1}$ and $\mathbf{430}_{1,2}$ to the launcher electronics associated with multi-cell launcher 102. Pallet annulus 428 and canister annulus 432 provide structure to hold shield 650 and seat 648 such that when pallet connector $\mathbf{208}_{i,j}$ is mated to canister connector $\mathbf{316}_{i,j}$, resilient contacts 430 and 434 are enclosed in an environment that is substantially free of externally-generated electro-magnetic radiation and substantially isolated from the external ambient environment. Pallet key 536 and canister key 538 ensure proper alignment of pallet annulus 428 to canister annulus 432 and resilient contacts 430 to resilient contacts 434.

Resilient contacts $\mathbf{430}_{1,1}$, $\mathbf{430}_{1,2}$, $\mathbf{434}_{1,1}$, and $\mathbf{434}_{1,2}$ are flexible, spring-loaded electrical contacts. When pallet connector $\mathbf{208}_{i,j}$ and canister connector $\mathbf{316}_{i,j}$ are mated, resilient contacts $\mathbf{430}_{1,1}$ and $\mathbf{434}_{1,1}$ are compressed against each other, and resilient contacts $\mathbf{430}_{1,2}$ and $\mathbf{434}_{1,2}$ are compressed against each other, and at least one contact in each compressed pair deforms. During a rocket launch, although vibration causes canister $\mathbf{204}_{i,j}$ and receptacle $\mathbf{206}_{i,j}$ to move with respect to one another, the resiliency of resilient contacts 430 and 434 ensures that positive electrical contact is maintained.

FIG. 7 depicts a cross-sectional view, as taken through the line a—a of FIG. 5, of the salient components of an alternative embodiment of the present invention. Referring to FIG. 7, pallet connector $\mathbf{208}_{i,j}$ comprises circuit board 652, pallet annulus 428 that includes shield seat 540 and seal seat 542, rigid contacts $\mathbf{756}_{1,1}$ and $\mathbf{756}_{1,2}$, pallet key 536, shield 650, and seal 648. Canister connector $\mathbf{316}_{i,j}$ comprises printed circuit board 654, canister annulus 432 that includes shield seat 544 and seal seat 546, resilient contacts $\mathbf{434}_{1,1}$ and $\mathbf{434}_{1,2}$, and pallet key 538.

As in the illustrative embodiment, when pallet connector $\mathbf{208}_{i,j}$ is mated to canister connector $\mathbf{316}_{i,j}$, printed circuit boards 652 and 654, pallet annulus 428, canister annulus 432, shield 650 and seal 648 together enclose rigid contacts 756 and resilient contacts 434 in an environment that is substantially free of externally-generated electro-magnetic radiation and substantially isolated from the external ambient environment. Additionally, as in the illustrative embodiment, pallet key 536 and canister key 538 ensure that pallet connector $\mathbf{208}_{i,j}$ mates properly to canister connector $\mathbf{316}_{i,j}$.

When pallet connector $\mathbf{208}_{i,j}$ and canister connector $\mathbf{316}_{i,j}$ are mated, resilient contact $\mathbf{430}_{1,1}$ is compressed against rigid contact $\mathbf{756}_{1,1}$, and resilient contact $\mathbf{430}_{1,2}$ is compressed against rigid contact $\mathbf{756}_{1,2}$ such that resilient contacts $\mathbf{430}_{1,1}$ and $\mathbf{430}_{1,2}$ deform. During a rocket launch, although vibration causes canister $\mathbf{204}_{i,j}$ and receptacle $\mathbf{206}_{i,j}$ to move with respect to one another, the resiliency of resilient contacts $\mathbf{430}_{1,1}$ and $\mathbf{430}_{1,2}$ ensures that positive electrical contact with rigid contacts $\mathbf{756}_{1,1}$ and $\mathbf{756}_{1,2}$ is maintained.

Figure 8:
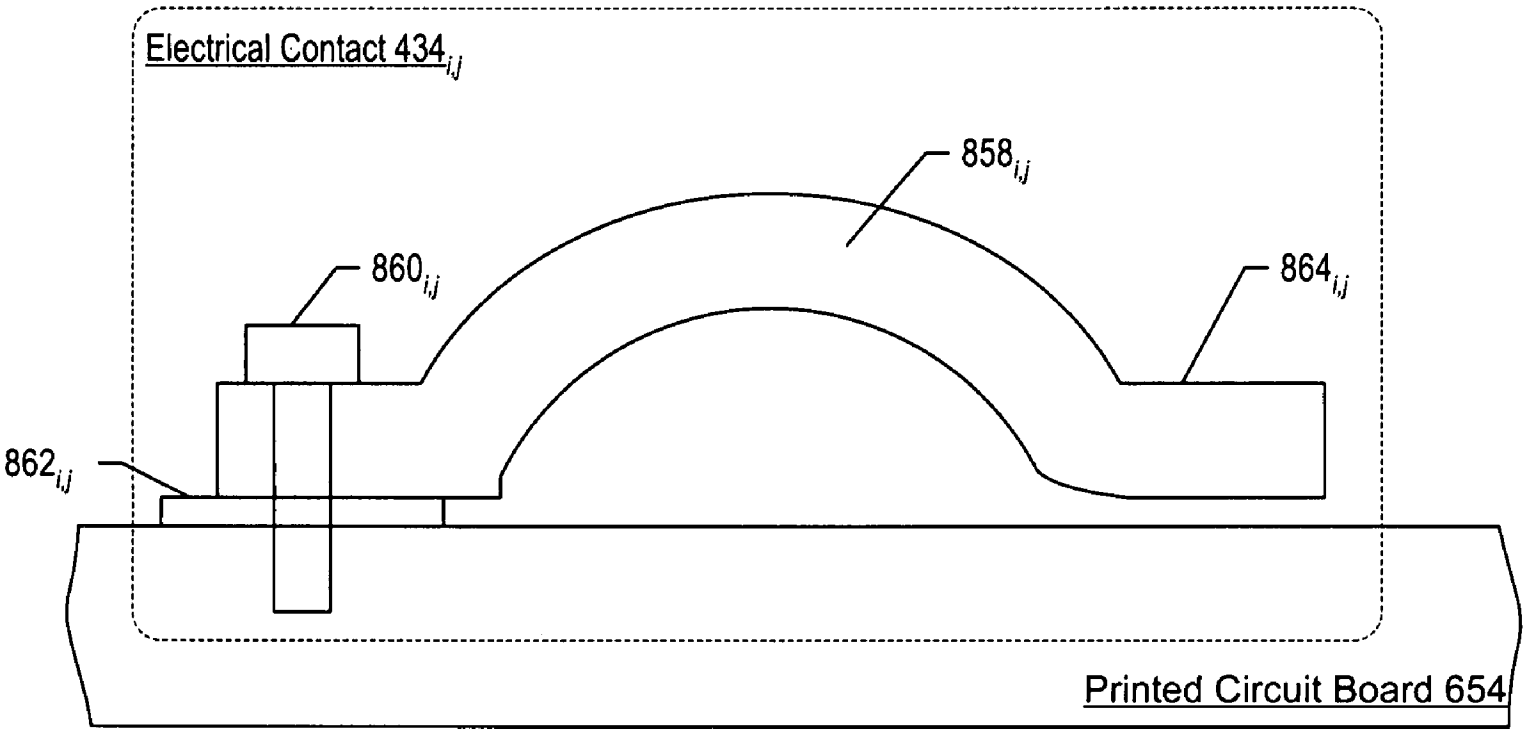
FIG. 8 depicts a cross-sectional view of the salient components of a resilient contact according to the illustrative embodiment of the present invention.

FIG. 8 depicts a cross-sectional view of the salient components of resilient contact $\mathbf{434}_{i,j}$ in accordance with to the illustrative embodiment of the present invention. Resilient contact $\mathbf{434}_{i,j}$ comprises spring $\mathbf{858}_{i,j}$ that includes free-end $\mathbf{864}_{i,j}$, and hold down $\mathbf{860}_{i,j}$.

Spring $\mathbf{858}_{i,j}$ is formed from an electrically-conductive, resilient material, such as copper, gold-alloy, bronze, or aluminum, as is well-known by those skilled in the art. At one end, spring $\mathbf{858}_{i,j}$ is fixidly-attached by hold down $\mathbf{860}_{i,j}$ to via pad $\mathbf{862}_{i,j}$ on printed circuit board 654. At the other end, spring $\mathbf{858}_{i,j}$ is left unattached in order to allow for flexibility and resiliency when mated to another contact.

Although the illustrative embodiment comprises two alignment features (i.e., (1) legs 320 and 322 and slots 424 and 426, and (2) keys 536 and 538), it will be clear to those skilled in the art, however, after reading this specification, how to make and use alternative embodiments of the present invention that comprise any number of alignment features, alternative alignment features, or embodiments that rely on shield 650, seal 648, or both shield 650 and seal 648 to ensure the alignment of canister $\mathbf{204}_{i,j}$ to receptacle $\mathbf{206}_{i,j}$.

Furthermore, it will be clear to those skilled in the art how to make and use alternative embodiments of the present invention in which shield 650 is located in shield seat 544, or seal 648 is located in seal seat 546, or shield 650 is located in shield seat 544 and seal 648 is located in seal seat 546.

Moreover, it will be clear to those skilled in the art how to make and use alternative embodiments of the present invention in which resilient contacts are formed using spring-loaded shaft-type contacts, leaf-spring contacts, button contacts, etc.

It is to be understood that the above-described embodiments are merely illustrative of the present invention and that many variations of the above-described embodiments can be devised by those skilled in the art without departing from the scope of the invention. For example, in this Specification, numerous specific details are provided in order to provide a thorough description and understanding of the illustrative embodiments of the present invention. Those skilled in the art will recognize, however, that the invention can be practiced without one or more of those details, or with other methods, materials, components, etc.

Furthermore, in some instances, well-known structures, materials, or operations are not shown or described in detail to avoid obscuring aspects of the illustrative embodiments. It is understood that the various embodiments shown in the Figures are illustrative, and are not necessarily drawn to scale. Reference throughout the specification to "one embodiment" or "an embodiment" or "some embodiments" means that a particular feature, structure, material, or characteristic described in connection with the embodiment(s) is included in at least one embodiment of the present invention, but not necessarily all embodiments. Consequently, the appearances of the phrase "in one embodiment," "in an embodiment," or "in some embodiments" in various places throughout the Specification are not necessarily all referring to the same embodiment. Furthermore, the particular features, structures, materials, or characteristics can be combined in any suitable manner in one or more embodiments. It is therefore intended that such variations be included within the scope of the following claims and their equivalents.

What is claimed is:

1. An apparatus comprising:

a first connector face;

a first projection, wherein said first projection depends from a region of said first connector face, and wherein said first projection is resilient and electrically conductive;

a seal for substantially isolating said region from an ambient environment, wherein said seal forms a first annulus that surrounds said region; and a shield for substantially isolating said region from external electro-magnetic radiation, wherein said shield forms a second annulus that surrounds said region.

2. The apparatus of claim 1 wherein said first annulus surrounds said second annulus.

3. The apparatus of claim 1 wherein said second annulus surrounds said first annulus.

4. The apparatus of claim 1 wherein said seal is a gasket comprising a material that is substantially impervious for air and moisture.

5. The apparatus of claim 1 wherein said shield is a gasket comprising electrically-conductive material.

6. The apparatus of claim 1 further comprising a second projection, wherein said second projection depends from said region of said first connector face, and wherein said second projection is resilient and electrically conductive.

7. The apparatus of claim 1 further comprising:

a second connector face;

a third projection, wherein said third projection depends from a region of said second connector face, and wherein said third projection is electrically conductive.

8. The apparatus of claim 7 wherein said third projection is resilient.

9. The apparatus of claim 7 wherein said third projection is rigid.

10. The apparatus of claim 7 further comprising an alignment feature, wherein said alignment feature ensures that said first projection aligns with and contacts said third projection.

11. The apparatus of claim 10 wherein said alignment feature comprises;

a first element for aligning said first connector face to said second connector face, wherein said first element is located on said first connector face; and a second element for aligning said first connector face to said second connector face, wherein said second element is located on said second connector face; and wherein said first element and said second element ensure that said first connector face and said second connector face align in a single orientation.

12. An apparatus comprising a self-mating connector, wherein said self-mating connector comprises;

(1) a first connector face comprising;

(a) a first annular region, wherein said first annular region surrounds a first planar region;

(b) a first projection, wherein said first projection depends from said first planar region, and wherein said first projection is resilient and electrically conductive; and (c) a second projection, wherein said second projection depends from said first planar region, and wherein said second projection is resilient and electrically conductive;

(2) a second connector face comprising;

(a) a second annular region, wherein said second annular region surrounds a second planar region;

(b) a third projection, wherein said third projection depends from said second planar region, and wherein said third projection is electrically conductive; and (c) a fourth projection, wherein said fourth projection depends from said second planar region, and wherein said fourth projection is electrically conductive;

(3) a seal for substantially isolating said first planar region and said second planar region from an ambient environment; and (4) a shield for substantially isolating said first planar region and said second planar region from external electro-magnetic radiation.

13. The apparatus of claim 12 wherein said third projection and said fourth projection are compliant.

14. The apparatus of claim 12 wherein said third projection and said fourth projection are rigid.

15. The apparatus of claim 12 wherein said shield comprises an electrically-conductive material.

16. The apparatus of claim 12 further comprising an alignment system for aligning said first connector face and said second connector face mate in a single orientation wherein;

said first projection aligns with and contacts said third projection;

said second projection aligns with and contacts said fourth projection;

said seal substantially isolates said first planar region and said second planar region from said ambient environment; and said shield substantially isolates said first planar region and said second planar region from external electro-magnetic radiation.

17. The apparatus of claim 12 wherein said alignment system comprises;

said first annular region; and said second annular region;

wherein said first annular region and said second annular region nest in a single orientation.

* * * * *

UNITED STATES PATENT AND TRADEMARK OFFICE

CERTIFICATE OF CORRECTION

PATENT NO. : 7,070,434 B2
APPLICATION NO. : 10/899654
DATED : July 27, 2004
INVENTOR(S) : Buddy R. Paul and Greg W. Klein It is certified that error appears in the above-identified patent and that said Letters Patent is hereby corrected as shown below:

Column 1, Line 4-5
Please add the following new paragraph [0001]:

[0001] This invention was made with Government support under contract DAAH01-03-C-0035 awarded by the US Army. The Government has certain rights in the invention.

Signed and Sealed this

Third Day of October, 2006

JON W. DUDAS
*Director of the United States Patent and Trademark Office*

UNITED STATES PATENT AND TRADEMARK OFFICE

CERTIFICATE OF CORRECTION

PATENT NO. : 7,070,434 B2
APPLICATION NO. : 10/899654
DATED : July 4, 2006
INVENTOR(S) : Buddy R. Paul and Greg W. Klein It is certified that error appears in the above-identified patent and that said Letters Patent is hereby corrected as shown below:

Column 1, Line 4-5
Please add the following new paragraph [0001]:

[0001] This invention was made with Government support under contract DAAH01-03-C-0035 awarded by the US Army. The Government has certain rights in the invention.

This certificate supersedes Certificate of Correction issued October 3, 2006.

Signed and Sealed this

Seventh Day of November, 2006

JON W. DUDAS
*Director of the United States Patent and Trademark Office*